US010907362B2

(12) United States Patent
Loyd

(10) Patent No.: US 10,907,362 B2
(45) Date of Patent: Feb. 2, 2021

(54) CLIP FOR CURTAIN WALL SYSTEM AND ASSOCIATED METHOD FOR INSTALLATION

(71) Applicant: Stephen N. Loyd Irrevocable Family Trust, Dallas, TX (US)

(72) Inventor: Stephen N. Loyd, Dallas, TX (US)

(73) Assignee: Stephen N. Loyd Irrevocable Family Trust, Dallas, TX (US)

( * ) Notice: Subject to any disclaimer, the term of this patent is extended or adjusted under 35 U.S.C. 154(b) by 29 days.

(21) Appl. No.: 15/598,040

(22) Filed: May 17, 2017

(65) Prior Publication Data

US 2017/0335564 A1 Nov. 23, 2017

Related U.S. Application Data

(60) Provisional application No. 62/338,268, filed on May 18, 2016.

(51) Int. Cl.
*E04F 13/08* (2006.01)

(52) U.S. Cl.
CPC ..... *E04F 13/0846* (2013.01); *E04F 13/0826* (2013.01)

(58) Field of Classification Search
CPC ..... E04F 13/0846; E04F 13/0826; E04F 13/0889; E04F 13/0814; E04F 13/0816; E04F 13/081; E04F 13/083; E04B 2/88; E04B 2/885
USPC ..... 52/235, 312, 508, 511, 713, 764, 474, 52/506.06, 506.05
See application file for complete search history.

(56) References Cited

U.S. PATENT DOCUMENTS

| | | | | |
|---|---|---|---|---|
| 2,245,785 | A | | 6/1941 | Jentzer, Jr. |
| 3,343,423 | A | | 9/1967 | Thorner |
| 3,640,043 | A | | 2/1972 | Querfeld et al. |
| 3,786,605 | A | | 1/1974 | Winfrey |
| 3,831,506 | A | | 8/1974 | Landheer |
| 4,483,122 | A | | 11/1984 | Crandell |
| 4,506,482 | A | | 3/1985 | Pracht et al. |
| 5,065,557 | A | * | 11/1991 | Laplante ..... E04B 2/96 52/235 |
| 5,155,958 | A | * | 10/1992 | Huff ..... E04F 13/0826 52/204.593 |
| 5,265,396 | A | | 11/1993 | Amimoto |

(Continued)

OTHER PUBLICATIONS

Mexican Patent Office; OA and English Translation Re: Examination Results; Application Pa/a/2006/002573, Ref. 205/025561; U.S. Appl. No. 11/074,086.

(Continued)

*Primary Examiner* — Theodore V Adamos
(74) *Attorney, Agent, or Firm* — Slater Matsil, LLP

(57) ABSTRACT

In certain embodiments, an apparatus includes a body, a first hook, and a second hook. The body of the apparatus includes a first surface and a second surface opposite to the first surface. The first hook extends from the first surface of the body, and the first hook and a portion of the body form a first channel. The first channel is adapted to receive a curtain wall member from a first direction. The second hook extends from the second surface of the body, and the second hook and the portion of the body form a second channel. The second channel is adapted to receive an intermediate member from a second direction that is opposite to the first direction.

20 Claims, 7 Drawing Sheets

(56) References Cited

U.S. PATENT DOCUMENTS 5,301,484 A 4/1994 Jansson
5,313,760 A 5/1994 Tojo
5,373,672 A * 12/1994 Schulz ..... B32B 17/10045 52/235
5,473,851 A 12/1995 Northrup, Jr.
6,098,364 A 8/2000 Liu
6,170,214 B1 * 1/2001 Treister ..... E04F 13/0808 52/235
6,202,377 B1 3/2001 Krieger
6,289,644 B1 * 9/2001 Gerhaher ..... E04F 13/0826 52/235
6,289,646 B1 * 9/2001 Watanabe ..... E04F 13/0821 52/235
6,792,727 B2 9/2004 Krieger
7,805,899 B2 10/2010 Montgomery
8,051,623 B2 11/2011 Loyd
8,336,264 B2 12/2012 Sato et al.
8,341,901 B2 1/2013 Loyd
8,839,582 B2 * 9/2014 Aboukhalil ..... E04F 19/022 52/460
9,080,331 B2 7/2015 Aboukhalil
9,506,252 B2 * 11/2016 Molteni ..... A47F 5/0846
2002/0005024 A1 1/2002 Hsueh
2002/0152693 A1 10/2002 Krogstad
2003/0150179 A1 8/2003 Moreno
2005/0246983 A1 11/2005 Loyd
2007/0022682 A1 * 2/2007 Morgenegg ..... E04B 2/90 52/235
2008/0010922 A1 * 1/2008 Wagner ..... E04F 13/0812 52/235
2008/0216444 A1 * 9/2008 Loyd ..... E04F 13/0803 52/742.16
2009/0031652 A1 * 2/2009 Ortega Gatalan .... E04F 13/081 52/235
2012/0117901 A1 5/2012 Loyd
2012/0137609 A1 6/2012 Loyd
2012/0317909 A1 * 12/2012 MacKenzie ..... E04F 13/0803 52/288.1

OTHER PUBLICATIONS

Canadian Intellectual Patent Office; OA Communication, Application 2,538,441, Ref. file No. 60622.

* cited by examiner

CLIP FOR CURTAIN WALL SYSTEM AND ASSOCIATED METHOD FOR INSTALLATION

RELATED APPLICATIONS

The present application claims benefit under 35 U.S.C. § 119 of U.S. Provisional Patent Application No. 62/338,268, filed May 18, 2016, by Stephen N. Loyd, and entitled "Supporting Apparatus for Curtain Wall System," which is incorporated herein by reference.

TECHNICAL FIELD

The present disclosure relates generally to construction, and more particularly to a clip for a curtain wall system and associated method for installation.

BACKGROUND

In certain instances, it may be desirable to change the appearance of an exterior or interior wall. Furthermore, it may be desirable to provide an exterior covering for, or enhance the aesthetic appearance of, such a wall. The use of certain materials to construct the wall, such as ceramic, stone, or other suitable materials, may be desirable. In many instances, difficulties may be encountered in supporting and constructing the desired wall. Often, these difficulties may result in problems such as ill-fitting portions and an inefficient, time-consuming installation process that yields a less than desirable result.

SUMMARY

In certain embodiments, an apparatus is disclosed. The apparatus includes a body, a first hook, and a second hook. The body of the apparatus includes a first surface and a second surface opposite to the first surface. The first hook extends from the first surface of the body, and the first hook and a portion of the body form a first channel. The first channel is adapted to receive a curtain wall member from a first direction. The second hook extends from the second surface of the body, and the second hook and the portion of the body form a second channel. The second channel is adapted to receive an intermediate member from a second direction that is opposite to the first direction.

Particular embodiments of the present disclosure may provide one or more technical advantages. For example, in certain embodiments, thin curtain wall members, such as curtain wall members having a thickness of approximately 0.5 inches (as just one particular example), may be installed with one or more members of the present disclosure in lieu of support anchors (e.g., undercut anchors), which may be aesthetically undesirable and which may not be suitable for thin curtain wall members (e.g., curtain wall members less than six inches thick.) In certain embodiments, the present disclosure may include a hook adapted to receive and/or support a bottom end of a curtain wall member. Some embodiments of the present disclosure may include a leg of the hook that engages with a kerf located along the bottom surface of the curtain wall member, which may provide for alignment of the curtain wall member.

As another technical advantage of certain embodiments, it may be desirable in some instances to provide support and alignment along both the top and bottom ends of a curtain wall member. In certain embodiments, rather than using a different member to align and/or support the top and bottom ends of the curtain wall member, the present disclosure includes a versatile member that can align and/or support the top and/or bottom ends of the curtain wall member by changing the orientation of the member, which may lower manufacturing costs and increase installation speed in the field.

As still another technical advantage of certain embodiments, the present disclosure may include one or more clips that can be attached to curtain wall members prior to installation of the curtain wall members onto a supporting structure for supporting the curtain wall members of a curtain walls. The clips may allow the curtain wall members to be mechanically mounted onto the supporting structure of the curtain wall, which may simplify the installation process, potentially reducing the burden on the installer to manually hold one or more installation components in place while mounting the curtain wall member to the supporting structure, and/or increase installation speed.

Certain embodiments of the present disclosure may provide some, all, or none of these advantages. Certain embodiments may provide one or more other technical advantages, one or more of which may be readily apparent to those skilled in the art from the figures, descriptions, and claims.

BRIEF DESCRIPTION OF THE DRAWINGS

To provide a more complete understanding of embodiments of the present disclosure and the features and advantages thereof, reference is made to the following description taken in conjunction with the accompanying drawings, in which.

DESCRIPTION OF EXAMPLE EMBODIMENTS

In many instances, it may be desirable to construct a facade along an exterior wall of a building. A curtain wall may be particularly desirable in certain circumstances, in part because of the range of materials available for use in a curtain wall system, as well as the pleasing aesthetics of such a curtain wall system. Often, however, the materials chosen for implementation in a curtain wall system are thin, making installation a challenge. Further difficulties may also be encountered in fitting the materials into a curtain wall system to achieve a desired appearance, often requiring much time and the use of additional components, such as undercut anchors, to achieve the desired result. At least certain embodiments of the present disclosure address these and potentially other deficiencies of existing systems and methods of constructing curtain walls.

Figure 1:
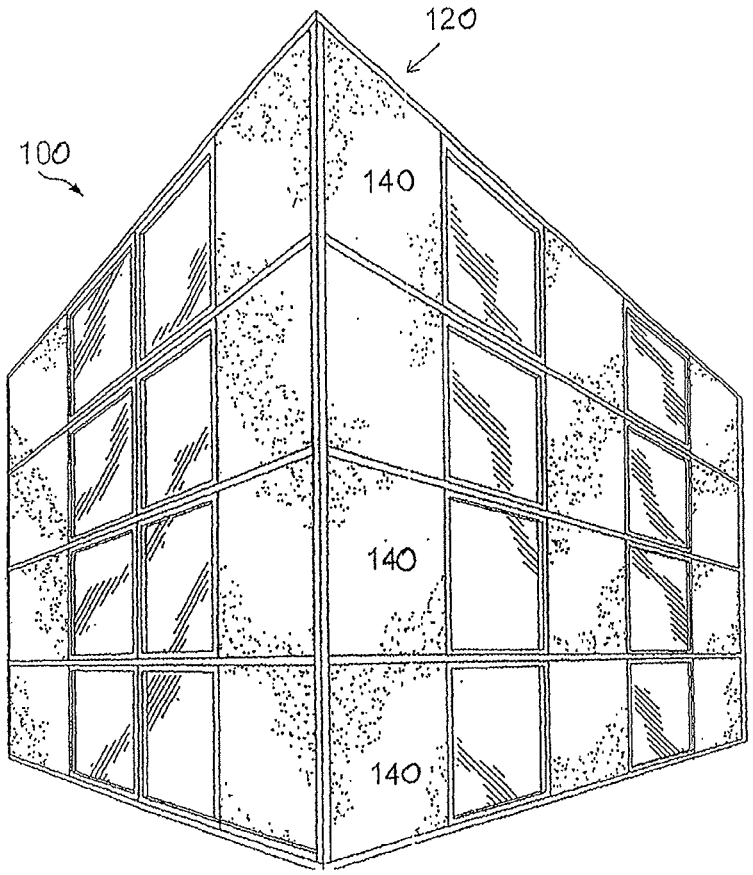
FIG. 1 illustrates an environmental view of an example of a curtain wall system installed according to certain embodiments of the present disclosure.

FIG. 1 illustrates an environmental view of an example curtain wall system 100 installed in accordance with certain embodiments of the present disclosure. In some embodiments, curtain wall system 100 includes one or more curtain walls 120 formed of one or more curtain wall members 140. In certain embodiments, curtain wall members are shaped material that is mounted to a wall of a structure, such as for example an exterior wall of a structure. Curtain wall members 140 may be composed of an ultra compact surface material, ceramic, stone, glass, aluminum, wood, composite graphite, or any other suitable material or combination of materials. Although curtain wall members 140 are shown as having a particular shape, the present disclosure contemplates curtain wall members 140 having any suitable shape.

Figure 2:
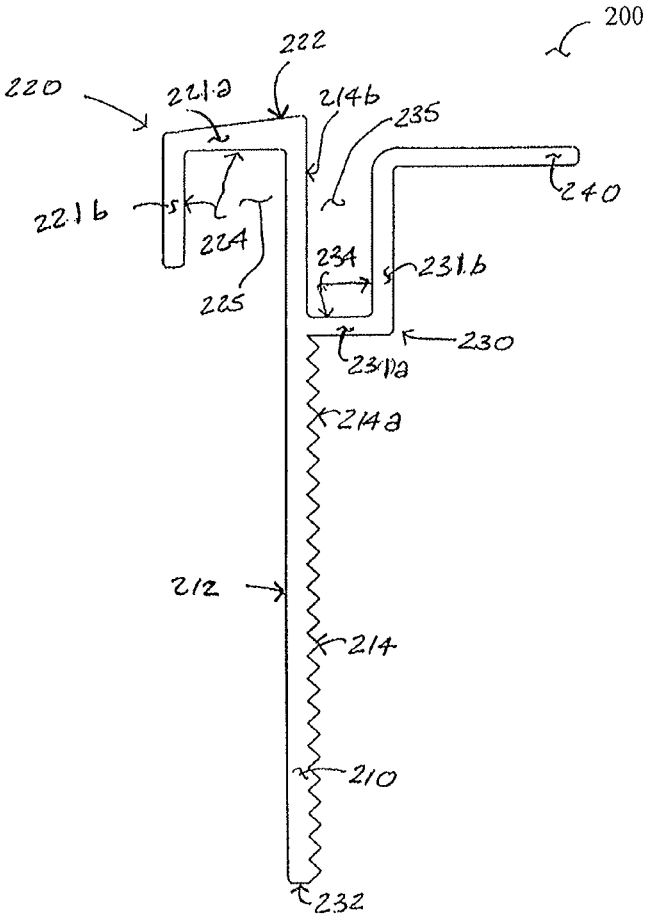
FIG. 2 illustrates a clip for supporting a curtain wall member according to certain embodiments of the present disclosure.
Figure 3:
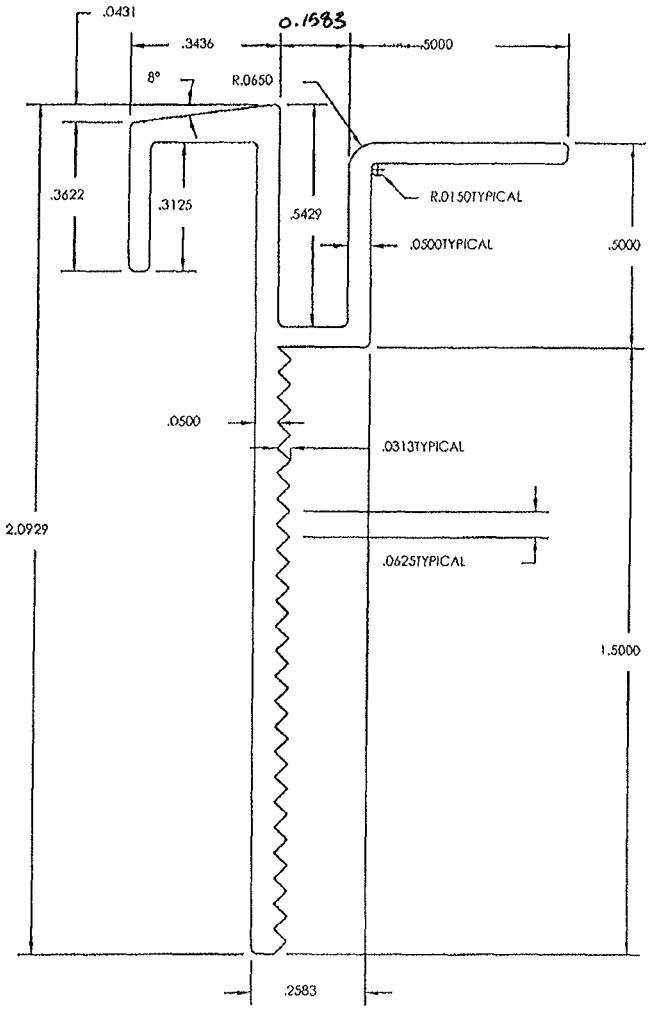
FIG. 3 illustrates example dimensions for the clip of FIG. 2 according to certain embodiments of the present disclosure.

FIG. 2 illustrates a clip 200 for supporting a curtain wall member 140 in accordance with certain embodiments of the present disclosure, and FIG. 3 illustrates example dimensions for clip 200 of FIG. 2 in accordance with certain embodiments of the present disclosure. In general, clip 200 may be considered a clip for attaching curtain wall members 140 to a support structure (e.g., one or more intermediate members described below) attached to a wall of a structure (e.g., a building).

Clip 200 of FIG. 2 includes a body 210, a first hook 220, a second hook 230, and a plate 240. In certain embodiments, body 210, first hook 220, second hook 230, and plate 240 are integrally connected. Clip 200 may be formed from any suitable material or combination of materials. In certain embodiments, clip 200 may be fabricated from plastic. Other materials, however, may be used in the fabrication of clip 200 depending on the considerations of particular applications of curtain wall system 100. For example, clip 200 may be fabricated from steel, aluminum, any other suitable material, or a combination thereof.

Body 210 of clip 200 may be an elongated member from which other elements of clip 200 extend or are otherwise directly or indirectly attached. In the illustrated embodiment of FIG. 2, body 210 of clip 200 is located between first hook 220 and second hook 230, or could be considered to form a portion of first hook 220 and a portion of second hook 230 at a location between first hook 220 and second hook 230. In certain embodiments, body 210 extends an entire width of clip 200. For example, body 210 may extend from end 222 to end 232 and have a width of approximately two inches as shown in FIG. 3, and clip 200 may also have a width of approximately two inches. In some embodiments, the thickness of body 210 ranges from 0.05 inches to 0.10 inches; however, the present disclosure contemplates body 210 having any suitable thickness, according to particular needs.

In the embodiment of FIG. 2, body 210 includes a first surface 212 and a second surface 214. Second surface 214 is opposite to first surface 212. In some embodiments, first surface 212 of body 210 has a smooth surface. For example, first surface 210 may be a flat, even surface that extends the length of clip 200. In certain embodiments, second surface 214 of body 210 may include different types of surfaces. For example, second surface 214 may include a serrated surface 214*a* in the shape of a sawtooth pattern and a smooth surface 214*b* similar to first surface 212. In certain embodiments, serrated second surface 214*a* may assist in coupling clip 200 to a substrate (e.g., one or more components of curtain wall 120). Although surfaces 212 and 214 are described as having particular characteristics (e.g., smooth, serrated, or a combination of the two), the present disclosure contemplates each of surfaces 212 and 214 having any suitable characteristics, according to particular needs. As just a few examples, both surfaces 212 and 214 may be serrated, both surfaces 212 and 214 may be entirely smooth, or first surface 212 may be serrated while second surface 214 may be smooth.

First hook 220 of the illustrated embodiment of FIG. 2 is an element of clip 200 that extends from first surface 212 of body 210. In certain embodiments, first hook 220 extends from first surface 212 of body 210 at or near an end 222 of body 210. First hook 220 may be an "L" shaped member that includes a first leg 221*a* and a second leg 221*b*. In the illustrated embodiment of FIG. 2, leg 221*a* is substantially perpendicular to body 210 and to second leg 221*b*, and second leg 221*b* is substantially parallel to body 210. A first end of leg 221*a* may extend from end 222 of first surface 212 of body 210. In some embodiments, the width of leg 221*a* is substantially the same as the width of leg 221*b*. For example, as shown in FIG. 3, the width of leg 221*a* is 0.34 inches and the width of leg 221*b* is 0.36 inches. In certain embodiments, the thickness of leg 221*a* varies across the width of leg 221*a*. For example, the thickness of leg 221*a* may be greater near body 210 than near leg 221*b*. In certain embodiments, the thickness of leg 221*a* may vary at a constant slope across one or more surfaces of leg 221*a*. In some embodiments, the thickness of leg 221*b* remains substantially the same along the width of leg 221*b*.

In certain embodiments, a first end of leg 221*b* may be coupled to a second end of leg 221*a* opposite to the first end of leg 221*a*. A second end of leg 221*b* opposite to the first end of leg 221*b* may be rounded, flat, or a combination thereof. For example, the second end of leg 221*b* may be rounded about a constant radius. As another example, the second end of leg 221*b* may be flat with rounded edges. Throughout this description, although particular components are shown and described as being rounded, the present disclosure contemplates the particular components having any suitable shapes, according to particular needs. As just one example, rather than having rounded edges, corners, or ends, as component may have sharp edges, corners, or ends.

As shown in FIG. 2, first hook 220 includes an inner surface 224. In certain embodiments, inner surface 224 of first hook 220 includes an inner surface of leg 221*a* and an inner surface of leg 221*b*. Inner surface 224 of first hook 220 may also include a rounded corner that forms a transition from leg 221*a* to leg 221*b*. In the illustrated embodiment of FIG. 3, the inner radius of the rounded corner between leg 221*a* and leg 221*b* is 0.015 inches.

Second hook 230 of the illustrated embodiment of FIG. 2 is an element of clip 200 that extends from second surface 214 of body 210. In certain embodiments, second hook 230 extends from second surface 214 of body 210 some distance from end 222 of body 210. Second hook 230 may be an "L" shaped member that includes a first leg 231*a* and a second leg 231*b*. In the illustrated embodiment of FIG. 2, first leg 231*a* is substantially perpendicular to body 210 and to second leg 231*b*, and second leg 231*b* is substantially parallel to body 210. An end of leg 231*a* extends from second surface 214 of body 210. In certain embodiments, the thickness of leg 231*a* remains substantially the same along the width of leg 231*a*. Similarly, the thickness of leg 231*b* may remain substantially the same along the width of leg 231*b*. In the illustrated embodiment of FIG. 3, the thicknesses of legs 231*a* and 231*b* are 0.05 inches.

As shown in FIG. 2, second hook 230 includes an inner surface 234. In certain embodiments, inner surface 234 of second hook 230 includes an inner surface of leg 231*a* and an inner surface of leg 231*b*. Inner surface 234 of second hook 230 may also include a rounded corner that forms a transition from leg 231*a* to leg 231*b*. In the illustrated embodiment of FIG. 3, the inner radius of the rounded corner between leg 231*a* and leg 231*b* is 0.015 inches.

In the illustrated embodiment of FIG. 2, second hook 230 is coupled to second surface 214 of body 210 near end 222 such that the adjoining location of second hook 230 to body 210 divides second surface 214 of body 210 into second surface 214*a* and second surface 214*b*. As shown in FIG. 2, second surface 214*a* extends from the adjoining location of second hook 230 to body 210 to end 232 and second surface 214*b* extends from the adjoining location of second hook 230 to body 210 to end 222.

In certain embodiments, first hook 220 and a portion of body 210 extending from end 222 form a first channel 225. As shown in the embodiment of FIG. 2, first channel 225 is a "U" shaped member with three flat sides and two rounded corners. Inner surface 224 of legs 221*a* and 221*b* of first hook 220 and a portion of surface 212 of body 210 form an inner surface of first channel 225. In certain embodiments, channel 225 is adapted to receive curtain wall member 140.

In some embodiments, second hook 230 and a portion of body 210 form a second channel 235. As shown in the illustrated embodiment of FIG. 2, second channel 235 and first channel 225 may share the same portion of body 210. In some embodiments, second channel 235 is a "U" shaped member with three flat sides and two rounded corners. In the illustrated embodiment of FIG. 2, first channel 225 and second channel 235 create an "S" shaped member. Inner surface 234 of legs 231*a* and 231*b* of second hook 230 and surface 214*b* of body 210 form an inner surface of second channel 235. In certain embodiments, the width of first channel 225 is different from the width of second channel 235. For example, the width of first channel 225 may be wider than the width of second channel 235. Second channel 235 may be adapted to receive an intermediate member (e.g., an intermediate supporting member or an intermediate latching member as described in FIG. 4 and FIG. 6 below.)

In the illustrated embodiment of FIG. 2, clip 200 further includes plate 240. Plate 240 may extend from an end of second hook 230. For example, plate 240 may extend from an end of leg 231*b* of second hook 230 such that a rounded corner is formed at the adjoining location. As shown in the illustrated embodiment of FIG. 3, the rounded corner between leg 231*b* and plate 240 may have an inner radius of 0.015 inches and an outer radius of 0.065 inches. In certain embodiments, plate 240 is substantially perpendicular to second leg 231*b* of second hook 230, second leg 221*b* of first hook 220, and body 210. In some embodiments, plate 240 is substantially parallel to first leg 231*a* of second hook 230 and leg 221*a* of first hook 220. In certain embodiments, plate 240 may include one or more smooth surfaces. In the illustrated embodiment of FIG. 3, plate 240 of clip 200 is 0.05 inches thick and 0.50 inches wide.

Clip 200 extends at least a portion of the length of curtain wall member 140 (e.g., in a horizontal direction along the top or bottom of curtain wall member 140). For example, clip 200 may extend the full length of curtain wall member 140. In this example, curtain wall member 140 may be five feet long, and clip 200 may extend the five feet of curtain wall member 140. The present disclosure contemplates clip 200 to have any suitable length, including extending less than the full length of curtain wall member 140, according to particular needs.

Although the present disclosure describes particular example dimensions for clip 200, these dimensions are provided for example purposes only. The present disclosure contemplates clip 200 having any suitable dimensions, according to particular needs. In certain embodiments, the dimensions of clip 200 may be different from those illustrated in FIG. 3. For example, the width of clip 200 may be more or less than two inches, the thickness of body 210 near end 222 may be more or less than 0.05 inches, and the radius of an inner corner may be more or less than 0.015 inches.

Figure 4:
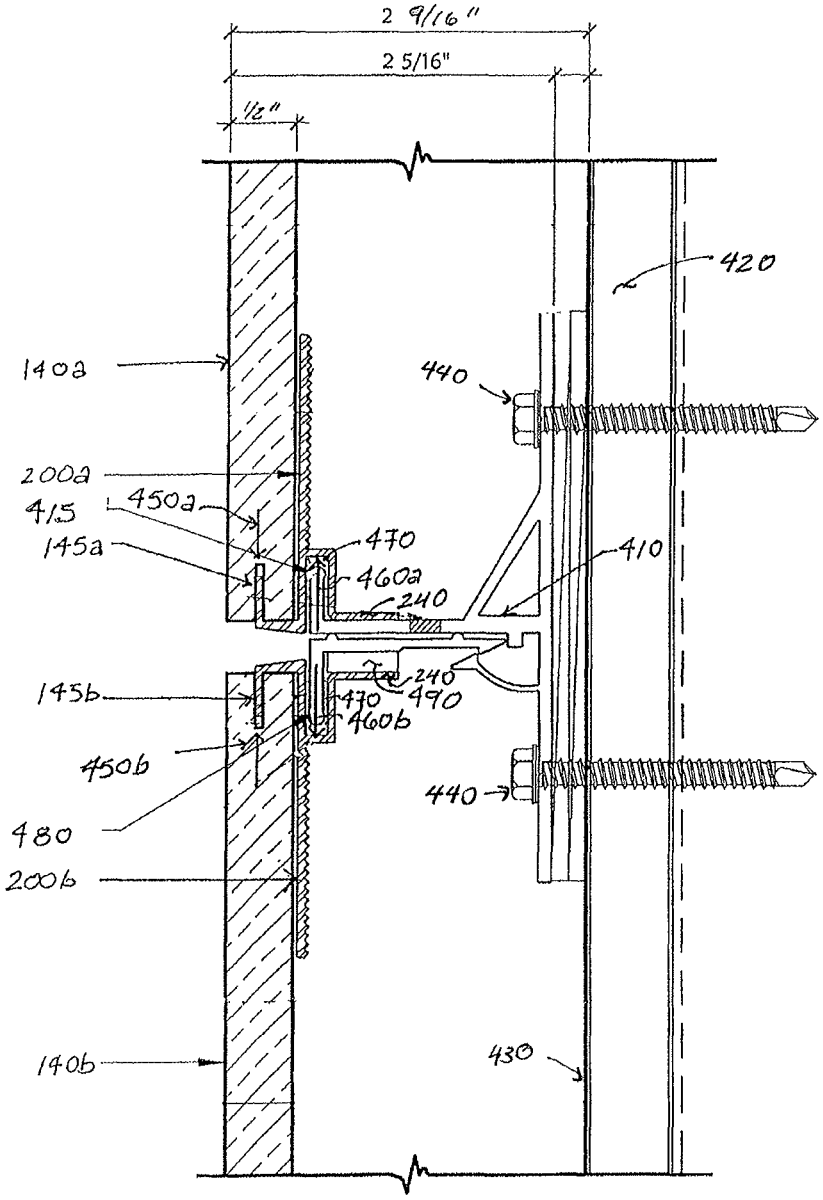
FIG. 4 illustrates example placement of the clip of FIG. 2 within an example curtain wall system according to certain embodiments of the present disclosure.

FIG. 4 illustrates example placement of clip 200 of FIG. 2 within an example curtain wall system in accordance with certain embodiments of the present disclosure. In particular, FIG. 4 illustrates example placement of clip 200 in curtain wall system 100. Clip 200 may be placed at different orientations within curtain wall system. As an example, clip 200 may be oriented such that body 210 of clip 200 is substantially vertical and first and second hooks 220 and 230 of clip 200 are located near the bottom of body 210 to provide support and/or alignment for a bottom end of a curtain wall member 140*a*, as illustrated by clip 200*a* in FIG. 4. As another example, clip 200 may be oriented such that body 210 of clip 200 is substantially vertical and first and second hooks 220 and 230 of clip 200 are located near the top of body 210 to provide support and/or alignment for a top end of a curtain wall member 140*b*, as illustrated by clip 200*b* in FIG. 4. As still another example, clip 200 may be oriented such that body 210 of clip 200 is substantially horizontal. For instance, clip 200 may be used to support and/or align a soffit member.

Clip 200 may be used to mount curtain wall member 140 to a wall 420 of a structure. In certain embodiments, one or more intermediate members (e.g., an intermediate supporting member 410 and an intermediate latching member 480) are used to couple clip 200 and an associated curtain wall member 140 to wall 420. The one or more intermediate members may facilitate load transfer between clip 200 and wall 420. As shown in the illustrated embodiment of FIG. 4, clip 200*a* is coupled to intermediate supporting member 410 and clip 200*b* is coupled to intermediate latching member 480, which is then used to mount clip 200*b* and its associated curtain wall member to intermediate supporting member 410.

Wall 420 may include any suitable combination of plywood, steel or wood studs, concrete masonry units (CMOs), concrete, or any other suitable material. In certain embodiments, wall 420 is an exterior or interior wall of a building or other structure. Wall 420 may be provided with a weather proof exterior layer 430, which may be fabricated using any suitable technique. As an example, weather proof exterior layer 430 may be self-sealing tape.

Intermediate supporting member 410 is secured to wall 420. For example, a number of intermediate supporting members 410 may be placed vertically and parallel to one another on wall 420 at an appropriate spacing, each intermediate supporting member 410 extending horizontally across wall 420. Multiple curtain wall members 140 may then be mounted, using clip 200 and, where appropriate, intermediate latching members 480, to these intermediate supporting members 410 to form the curtain wall, potentially forming multiple rows and columns of curtain wall members 140, as shown for example in FIG. 1.

In certain embodiments, multiple clips 200*a* (and associated curtain wall members 140) are coupled to multiple intermediate supporting members 410, multiple clips 200*b* are coupled to multiple intermediate latching members 480, multiple intermediate latching members 480 are coupled to multiple intermediate supporting members 410, and/or multiple intermediate supporting members 410 are secured to wall 420. For example, a first clip 200 may be located at a bottom end of curtain wall member 140 (e.g., as shown in FIG. 4 with clip 200*a* at a bottom end of curtain wall member 140*a*) to mount curtain wall member 140 to intermediate supporting member 410. As another example, a second clip 200 may be located at a top end of a curtain wall member 140 (e.g., as shown in FIG. 4 with clip 200*b* at a top end of curtain wall member 140*b*) to mount curtain wall member 140 to intermediate latching member 480. This arrangement may be used to mount multiple curtain wall members 140 to one or more walls 420, using clips 200 and intermediate members (e.g., intermediate supporting members 410 and intermediate latching members 480.) In certain embodiments, a single intermediate supporting member 410 may extend horizontally along a length of wall 420 and support mounting of multiple horizontally adjacent curtain wall members 140. In certain embodiments, a distinct intermediate latching member 480 may be used to mount each curtain wall member 140 (via clip 200) to intermediate supporting member 410.

Intermediate supporting members 410 may be secured to wall 420 in any suitable manner, such as by one or more suitable fasteners 440. Fasteners 440 may assist in transferring loads (e.g., dead loads, wind loads, and/or seismic loads) from intermediate supporting members 410 to wall 420. The number of fasteners 440 for affixing intermediate supporting members 410 to wall 420 may vary according to a particular application of curtain wall system 100. In certain embodiments, fasteners 440 may be placed at opposite ends of intermediate supporting members 410. Such an arrangement of fasteners 440 may provide optimal strength for load requirements. In certain other embodiments, intermediate supporting members 410 may be secured to wall 420 using a single fastener 440. The present disclosure contemplates the use of any suitable number of fasteners in affixing intermediate supporting members 410 to wall 420.

Intermediate supporting members 410 may be formed from any suitable material or combination of materials. In certain embodiments, intermediate supporting members 410 may be fabricated from plastic or metal. Other materials, however, may be used in the fabrication of intermediate supporting members 410 depending upon the requirements of particular applications of curtain wall system 100. Similarly, intermediate latching members 480 may be formed from any suitable material or combination of materials. In some embodiments, intermediate latching members 480 may be fabricated from plastic or metal. Other materials, however, may be used in the fabrication of intermediate latching members 480 depending upon the requirements of particular applications of curtain wall system 100.

As shown in the embodiment of FIG. 4, clip 200*a* is used to mount curtain wall member 140*a* to intermediate supporting member 410. In certain embodiments, first hook 220 of clip 200*a* is adapted to receive curtain wall member 140*a* from a direction 450*a*. For example, clip 200*a* may be adapted to receive load (e.g. dead load) induced by curtain wall member 140*a* from direction 450*a*. In the illustrated embodiment of FIG. 4, direction 450*a* is a downward direction such that an inner surface of first leg 221*a* of first channel 225 of clip 200*a* faces an upward direction opposite to direction 450*a*. Body 210 of clip 200*a* may be substantially vertical such that body 210 is flush with curtain wall member 140*a*. In certain embodiments, first surface 212 of body 210 faces curtain wall member 140*a* and second surface 214 of body 210 faces wall 420.

In some embodiments, first hook 220 of clip 200*a* is adapted to be inserted in a kerf 145*a* of curtain wall member 140*a*. For example, leg 221*b* of first hook 220 may extend in a vertical direction and be inserted in kerf 145*a* located along a bottom end of curtain wall member 140*a*. The portion of the bottom end of curtain wall member 140*a* on one side of kerf 145*a* may be flush with an inner surface of leg 221*a* of first hook 220. The portion of the bottom end of curtain wall member 140*a* on the other side of kerf 145*a* may extend beyond clip 200*a*. In certain embodiments, one or more loads (e.g., dead load) induced by curtain wall member 140*a* is transferred to clip 200*a*. For example, clip 200*a* may support a dead load induced by curtain wall member 140*a* in direction 450*a*.

In the illustrated embodiment of FIG. 4, clip 200*a* is adapted to receive a receiving-and-retaining member 415 of intermediate supporting member 410. In the illustrated example, receiving-and-retaining member 415 is a portion of intermediate supporting member 410 that extends substantially perpendicularly from an end of intermediate supporting member 410 farthest away from wall 420. In certain embodiments, inner surface 234 of second hook 230 of clip 200*a* may be adapted to receive receiving-and-retaining member 415 from a direction 460*a*. Direction 460*a* is opposite to direction 450*a*. In the embodiment of FIG. 4, direction 460*a* is an upward direction such that an inner surface of leg 231*a* of second channel 235 of clip 200*a* faces a downward direction opposite to direction 460*a*. In certain embodiments, a space between receiving-and-retaining member 415 of intermediate supporting member 410 and inner surface 234 of second hook 230 of clip 200*a* is filled with silicone 470 or another suitable material for securing receiving-and-retaining member 415 of intermediate supporting member 410 to second hook 230 of clip 200*a*. In some embodiments, silicone 470 is a low modulus silicone with expansive and compressive properties.

As shown in the embodiment of FIG. 4, plate 240 of clip 200*a* is flush with an upper surface of intermediate supporting member 410. In certain embodiments, clip 200*a* transfers a load induced by curtain wall member 140*a* to intermediate supporting member 410, and plate 240 of clip 200*a* assists in distributing the transferred load to intermediate supporting member 410.

Turning to clip 200*b* and curtain wall member 140*b*, in the embodiment of FIG. 4, clip 200*b* is located between intermediate latching member 480 and curtain wall member 140*b*. As shown, clip 200*b* may be oriented in a direction that mirrors the orientation of clip 200*a* about an imaginary horizontal line. In certain embodiments, first hook 220 of clip 200*b* is adapted to receive curtain wall member 140*b*. For example, clip 200*b* may be adapted to receive load induced by curtain wall member 140*b* from direction 450*b*. In the illustrated embodiment of FIG. 4, direction 450*b* is an upward direction such that an inner surface of first leg 221*a* of first channel 225 of clip 200*b* faces a downward direction opposite to direction 450*b*. Body 210 of clip 200*b* may be substantially vertical such that body 210 is flush with curtain wall member 140*b*. In certain embodiments, first surface 212 of body 210 of clip 200*b* faces curtain wall member 140*b* and second surface 214 of body 210 of clip 200*b* faces wall 420.

In some embodiments, first hook 220 of clip 200*b* is inserted in a kerf 145*b* of curtain wall member 140*b*. For example, leg 221*b* of first hook 220 of clip 200*b* may extend in a vertical direction be inserted in kerf 145*b* located along a top end of curtain wall member 140*b*. The portion of the top end of curtain wall member 140*b* on one side of kerf 145*b* may rest on and/or be flush with an inner surface of leg 221*a* of first hook 220 of clip 200*b*. The portion of the top end of curtain wall member 140*b* on the other side of kerf 145*b* may extend beyond clip 200*b*. In certain embodiments, one or more loads induced by curtain wall member 140*b* are transferred to clip 200*b*.

In the illustrated embodiment of FIG. 4, clip 200*b* is adapted to receive intermediate latching member 480. For example, inner surface 234 of second hook 230 of clip 200*b* may be adapted to receive intermediate latching member 480 from a direction 460*b*. Direction 460*b* is opposite to direction 450*b*. In the embodiment of FIG. 4, direction 460*b* is a downward direction such that an inner surface of leg 231*a* of second channel 235 of clip 200*b* faces an upward direction opposite to direction 460*b*. In certain embodiments, a space between intermediate latching member 480 and second inner portion 234 of second hook 230 of clip 200*b* is filled with silicone 470 or another suitable material for securing intermediate latching member 480 to second hook 230 of clip 200*b*.

As shown in the embodiment of FIG. 4, plate 240 of clip 200*b* is flush with foam 490. Foam 490 is situated between plate 240 and intermediate latching member 480. Foam 490 may be foam tape with expansive and/or compressive properties. In certain embodiments, clip 200*b* transfers one or more loads induced by curtain wall member 140*b* to intermediate latching member 480. Intermediate latching member 480 may transfer load received from clip 200*b* to intermediate supporting member 410. Intermediate supporting member 410 may transfer load (e.g., load received from intermediate latching member 480) to wall 420. In certain embodiments, plate 240 of clip 200*b* assists in distributing load (e.g., load transferred to plate 240) to intermediate latching member 480 through foam 490. In some embodiments, intermediate latching member 480 may assist in the alignment of clip 200*b*.

Although particular example dimensions and distances are shown in FIG. 4, the present disclosure provides these dimensions and distances provided for example purposes only. The present disclosure contemplates any suitable dimensions and distances, according to particular needs.

Figure 5:
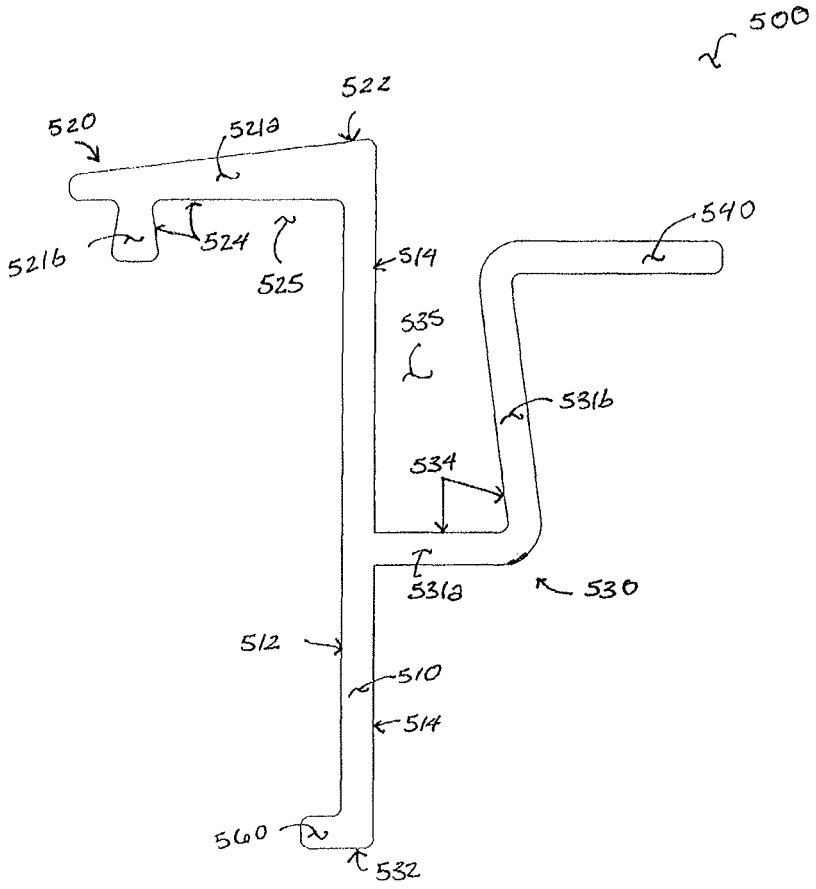
FIG. 5 illustrates another embodiment of a clip for supporting a curtain wall member according to certain embodiments of the present disclosure.

FIG. 5 illustrates another embodiment of a clip 500 for supporting a curtain wall member 140 in accordance with certain embodiments of the present disclosure. As with clip 200 of FIG. 2, in general, clip 500 may be considered a clip for attaching curtain wall members 140 to a support structure (e.g., one or more intermediate members described above) attached to wall 240 of a structure (e.g., a building).

Clip 500 of FIG. 5 includes a body 510, a first hook 520, a second hook 530, and a plate 540. In certain embodiments, body 510, first hook 520, second hook 530, and plate 540 are integrally connected. Clip 500 may be formed from any suitable material or combination of materials. In certain embodiments, clip 500 may be fabricated from plastic. Other materials, however, may be used in the fabrication of clip 500 depending upon the considerations of particular applications of curtain wall system 100. For example, clip 500 may be fabricated from steel, aluminum, any other suitable material, or a combination thereof.

Body 510 of clip 500 may be an elongated member from which other elements of clip 500 extend or are otherwise directly or indirectly attached. In the illustrated embodiment of FIG. 5, body 510 of clip 500 is located between first hook 520 and second hook 530, or could be considered to form a portion of first hook 520 and a portion of hook 530 at a location between first hook 520 and second hook 530. In certain embodiments, body 510 extends an entire width of clip 500. For example, body 510 may extend from end 522 to end 532 and have a width from end 522 to end 532 of approximately two inches. In the illustrated embodiment of FIG. 5, the thickness of body 510 is consistent from end 522 to end 532. In other embodiments, such as clip 200 of FIG. 2; however, the present disclosure contemplates body 510 having any suitable thickness, according to particular needs.

In the embodiment of FIG. 5, body 510 includes a first surface 512 and a second surface 514. Second surface 514 is opposite to first surface 512. First surface 512 and second surface 514 of body 510 may both be smooth surfaces. In certain embodiments, first surface 512 and/or second surface 514 may include other types of surfaces, such as textured surfaces. In some embodiments, first surface 512 and/or second surface 514 may each include multiple types of surfaces. For example, first surface 512 may include a smooth surface and a textured surface. Although surfaces 512 and 514 are described as having particular characteristics (e.g., smooth, serrated, or a combination of the two), the present disclosure contemplates each of surfaces 512 and 514 having any suitable characteristics, according to particular needs. As just a few examples, both surfaces 512 and 514 may be serrated, both surfaces 512 and 514 may be entirely smooth, or first surface 512 may be serrated while second surface 514 may be smooth.

First hook 520 of the illustrated embodiment of FIG. 5 is an element of clip 500 that extends from first surface 512 of body 510. In certain embodiments, first hook 520 extends from first surface 512 of body 510 at or near end 522 of body 510. In the illustrated embodiment of FIG. 5, first hook 520 is a "T" shaped member that includes a first leg 521*a* and a second leg 521*b*. An end of leg 521*a* extends from first surface 512 of body 510 at or near end 522 of first surface 512 of body 510. In some embodiments, the width of leg 521*a* is greater than the width of leg 521*b*. In certain embodiments, a thickness of leg 521*a* varies across the width of leg 521*a*. For example, the thickness of leg 521*a* may be greater near body 510 than near leg 521*b*. The thickness of leg 521*a* may vary at a constant slope across one or more surfaces of leg 521*a*.

In the illustrated embodiment of FIG. 5, leg 521*b* extends substantially perpendicularly from leg 521*a*. In certain embodiments, a first end of leg 521*b* extends from leg 521*a* at or near an end of leg 521*a*. As shown in FIG. 5, leg 521*a* may extend beyond leg 521*b*; however, the present disclosure contemplates leg 521*a* not extending beyond leg 521*b*. In certain embodiments, an end of leg 521*a* that extends beyond leg 521*b* may be rounded. In some embodiments, the end of leg 521*a* that extends beyond leg 521*b* may be flat with rounded corners. In some embodiments, a second end of leg 521*b* opposite to the first end of leg 521*b* is flat with rounded edges. The thickness of leg 521*b* may vary throughout the width of leg 521*b*. In the illustrated embodiment of FIG. 5, the thickness of leg 521*b* at the first end of leg 521*b* adjoining to leg 521*a* is less than the thickness of leg 521*b* at the second end of leg 521*b* farthest away from leg 521*a*. The thickness of leg 521*b* may vary at a constant slope across one or more surfaces of leg 521*b*. As shown in FIG. 5, the length of leg 521*b* is shorter than the length of leg 221*b* in FIG. 2. As just one particular example, the length of leg 521*b* may be less than 0.36 inches (e.g., 0.25 inches). In certain embodiments, the shorter length of leg 521*b* may simplify the fabrication process of curtain wall members 140*a* and 140*b* of system 100 by reducing the depths of kerfs 145*a* and 145*b* in curtain wall members 140. In certain embodiments, the shorter length of leg 521*b* may reduce or eliminate spoilage of curtain wall members 140*a* and 140*b* of system 100 and/or may provide for greater flexibility during installation of curtain wall members 140.

As shown in FIG. 5, first hook 520 of clip 500 includes a first inner surface 524. In certain embodiments, first inner surface 524 includes an inner surface of leg 521*a* and an inner surface of leg 521*b*. First inner surface 524 may include a rounded corner that forms a transition from leg 521*a* to leg 521*b*.

Second hook 530 of the illustrated embodiment of FIG. 5 is an element of clip 500 that extends from second surface 514 of body 510. In certain embodiments, second hook 530 extends from second surface 514 of body 510 some distance from end 522 of body 510. In the illustrated embodiment of FIG. 5, second hook 530 extends from body 510 closer to end 532 of body 510 than to end 522 of body 510. In some embodiments, second hook 530 extends from body 510 at or near a midpoint of body 510.

Second hook 530 may be an "L" shaped member that includes a first leg 531*a* and a second leg 531*b*. In the illustrated embodiment of FIG. 5, leg 531*a* extends from 531*b*. In certain embodiments, leg 531*b* transitions into leg 531*a* such that no joint is formed. An end of leg 531*a* may extend from second surface 514 of body 510. In certain embodiments, the thickness of leg 531*a* remains substantially the same along the width of leg 531*a*. In some embodiments, the thickness of leg 531*b* may remain substantially the same along the width of leg 531*b*.

In the illustrated embodiment of FIG. 5, leg 531*a* and leg 531*b* form an acute angle such that leg 531*a* is substantially perpendicular to body 510 and leg 531*b* is bent inward toward body 510. In some embodiments, legs 531*a* and 531*b* may form a right angle such that leg 531*b* and body 510 are substantially parallel. In some embodiments, leg 531*a* and leg 531*b* may form an obtuse angle such that leg 531*b* is bent outward away from body 510. In the illustrated embodiment of FIG. 5, the width leg 531*a* is shorter than the width of leg 531*b*. In certain embodiments, leg 531*a* and leg 531*b* may be the same width. In some embodiments, the width of leg 531*a* may be longer than the width of leg 531*b*. In the embodiment of FIG. 5, legs 531*a* and 531*b* have the same thickness. In certain embodiments, legs 531*a* and 531*b* may have different thicknesses. For example, leg 531*a* may be thinner than leg 531*b*. As another example, the thickness of leg 531*a* may vary along the width of leg 531*a*, while the thickness of leg 531*b* remains substantially the same along the width of leg 531*b*.

As shown in FIG. 5, second hook 530 includes an inner surface 534. In certain embodiments, inner surface 534 includes an inner surface of leg 531*a* and an inner surface of leg 531*b*. Inner surface 534 may include a rounded corner that forms a transition from leg 531*a* to leg 531*b*. In certain embodiments, the rounded corner that forms this transition from leg 531*a* to leg 531*b* is recessed such that a cavity is formed along inner surface 534.

Figure 7:
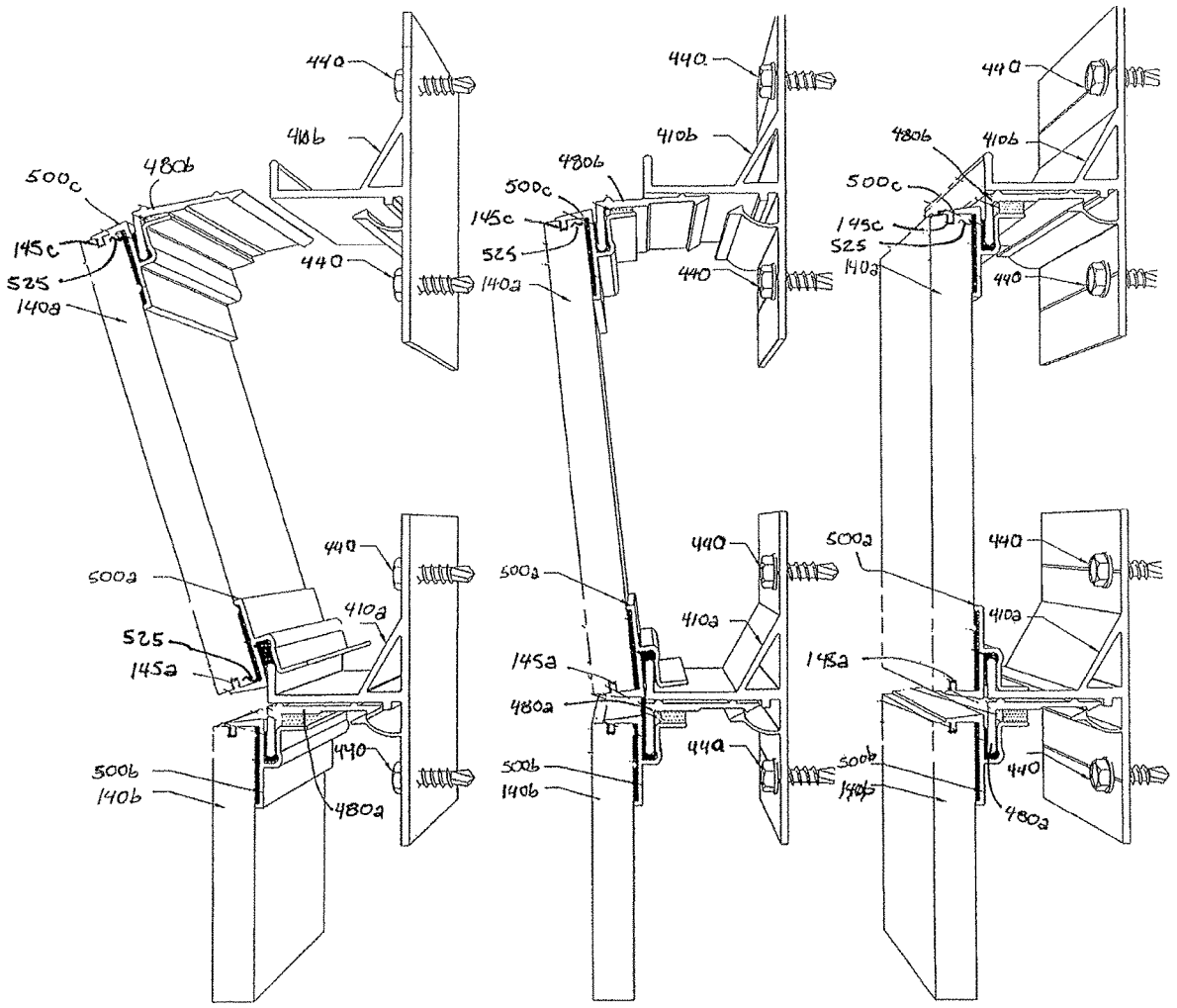
FIG. 7 illustrates an example installation process for mounting a curtain wall member to a wall using a clip according to certain embodiments of the present disclosure.

In the illustrated embodiment of FIG. 5, first hook 520 and a portion of body 510 form a first channel 525. As shown in the embodiment of FIG. 5, first channel 525 is a "U" shaped member with three flat sides and two rounded corners. Inner surface 524 of legs 521*a* and 521*b* of first hook 220 and a portion of surface 512 of body 510 form an inner surface of first channel 525. First channel 525 may be adapted to receive curtain wall member 140. In some embodiments, the length of first channel 525 extends length 550 of clip 500, as shown in FIG. 7.

In some embodiments, second hook 530 and a portion of body 510 form a second channel 535. As shown in the illustrated embodiment of FIG. 5, second channel 535 and first channel 525 may share the same portion of body 510. In some embodiments, second channel 535 is a "U" shaped member with three flat sides, a rounded corner between leg 531*a* and body 510, and a rounded corner between leg 531*a* and leg 531*b*. In the illustrated embodiment of FIG. 5, first channel 525 and second channel 535 create an "S" shaped member. Inner surface 534 of legs 531*a* and 531*b* of second hook 550 and surface 514 of body 510 form an inner surface of second channel 535. In certain embodiments, the width of first channel 525 is different from the width of second channel 535. For example, the width of first channel 525 may be wider than the width of second channel 535. Second channel 535 may be adapted to receive an intermediate member (e.g., intermediate supporting member 410 or intermediate latching member 480.)

In the illustrated example, second channel 535 is wider at the base of channel 535 near leg 531*a* and narrower at the opposite end of second channel 535 near leg 521*a*, with the width narrowing gradually from the base of second channel 535 to the opposite end of channel 535. In certain embodiments, the wider base of second channel 535 provides flexibility for intermediate latching member 480 to rotate when engaging with intermediate supporting member 410, potentially easing the process of installing curtain wall members 140.

In the illustrated embodiment of FIG. 5, clip 500 further includes plate 540. Plate 540 extends from an end of second hook 530. For example, plate 540 may extend from an end of leg 531*b* of second hook 530 such that a rounded corner is formed at the adjoining location. In certain embodiments, plate 540 and second leg 531*b* of second hook 530 form an acute angle. In certain embodiments, plate 540 is substantially perpendicular to leg 521*b* of first hook 520 and body 510. In some embodiments, plate 540 is substantially parallel to first leg 531*a* of second hook 530 and first leg 521*a* of first hook 520. In certain embodiments, plate 540 may include one or more smooth surfaces.

As shown in FIG. 5, clip 500 includes a lip 560 that extends from end 532 of body 510. In certain embodiments, lip 560 may be integrally coupled to body 510 at or near end 532. Lip 560 may be perpendicular to body 510. An intersection between lip 560 and body 510 may form an inner rounded corner and an outer rounded corner. In the illustrated embodiment of FIG. 5, an end of lip 560 farthest away from body 510 is flat with rounded corners.

Clip 500 extends at least a portion of the length of a curtain wall member 140 (e.g., in a horizontal direction along the top or bottom of curtain wall member 140). For example, clip 500 may extend the full length of curtain wall member 140. In this example, curtain wall member 140 may be five feet long, and clip 500 may extend the five feet of curtain wall member 140. The present disclosure contemplates clip 500 to have any suitable length, including extending less than the full length of curtain wall member 140, according to particular needs.

The present disclosure contemplates clip 500 having any suitable dimensions, according to particular needs. In certain embodiments, the dimensions of clip 500 may be different from those illustrated in FIG. 5. For example, the width of channel 535 may be wider than the width of channel 525 in some embodiments.

Figure 6:
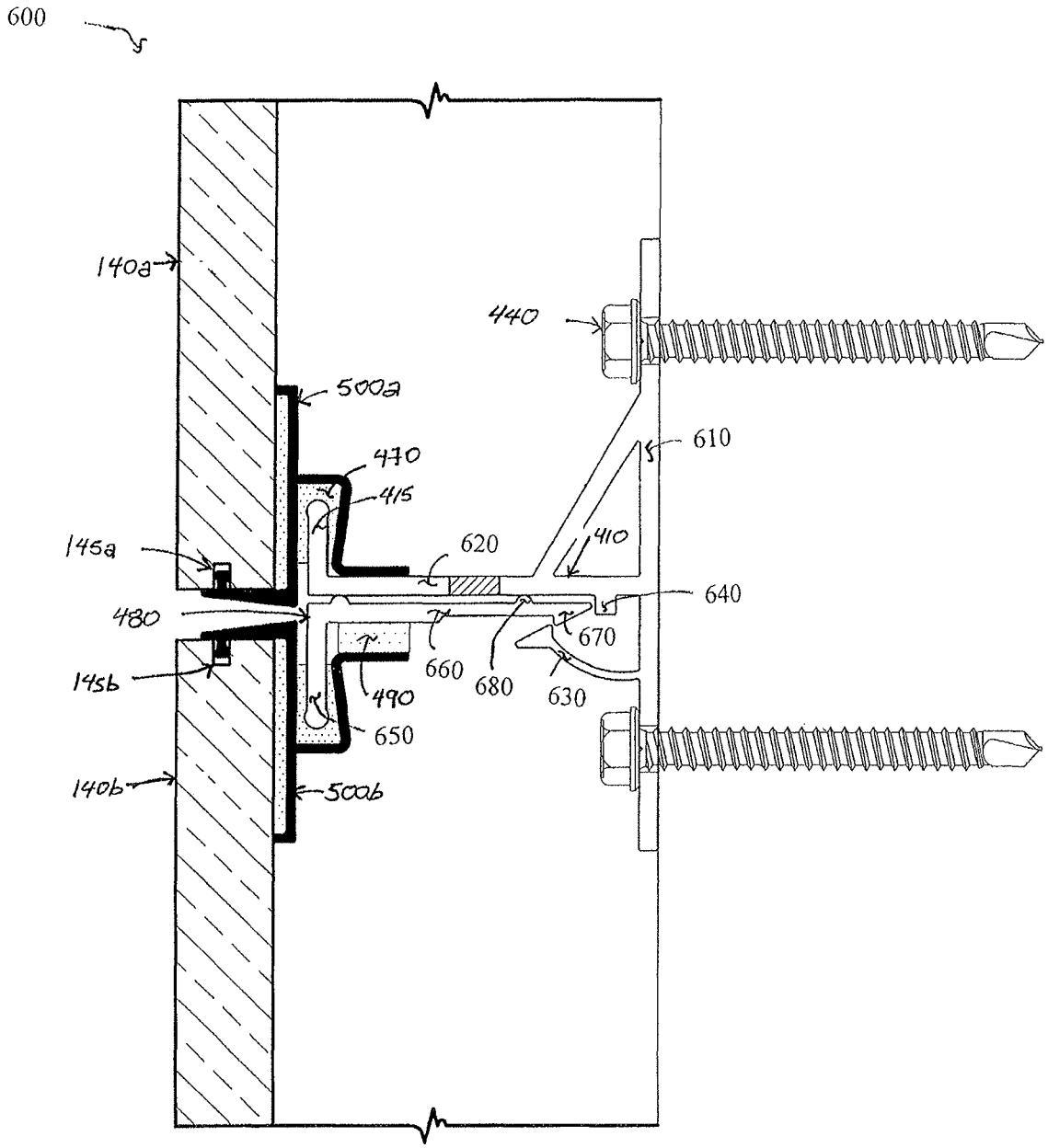
FIG. 6 illustrates a system for supporting one or more curtain wall members according to certain embodiments of the present disclosure.

FIG. 6 illustrates a system 600 for supporting one or more curtain wall members 140 according to certain embodiments of the present disclosure. As shown in FIG. 6, system 600 includes curtain wall members 140*a* and 140*b*, intermediate supporting member 410, intermediate latching member 480, and clips 500*a* and 500*b*.

Curtain wall members 140*a* and 140*b* of system 600 are any curtain walls used to form one or more curtain walls 120. Curtain wall members 140*a* and 140*b* may be composed of an ultra compact surface material, ceramic, stone, glass, aluminum, wood, composite graphite, or any other suitable material or combination of materials. In the illustrated embodiment of FIG. 6, curtain wall members 140*a* and 140*b* of system 600 are composed of an ultra compact surface material.

Intermediate supporting member 410 of system 600 may include receiving-and-retaining member 415, a vertically-disposed member 610, a horizontally-disposed member 620, a locking member 630, and a stop 640. Vertically-disposed member 610 may be disposed vertically adjacent to a wall (e.g., wall 420) of a structure to which curtain wall 120 is being mounted. An inner surface of vertically-disposed member 610 may be adapted to rest substantially flush against a wall (e.g., wall 420 of FIG. 4), though the present disclosure contemplates there being any suitable intervening components or materials. Vertically-disposed member 610 may be fastened to the wall with one or more fasteners 440.

Horizontally-disposed member 620 of intermediate supporting member 410, as shown, extends substantially perpendicularly outwardly from vertically-disposed member 610. In certain embodiments, receiving-and-retaining member 415 may extend substantially perpendicularly upwardly from an end of horizontally-disposed supporting member 620. Locking member 630 of intermediate supporting member 410 may have any suitable size and shape, according to particular needs. In the illustrated embodiments of FIG. 6, the shape of locking member 630 resembles a hook.

Intermediate supporting member 410 may also include stop 640 positioned on the underside of intermediate supporting member 410. In the illustrated embodiment of FIG. 6, stop 640 extends downward from the underside of horizontally-disposed member 620 near an end of horizontally-disposed member 620. In certain embodiments, stop 640 extends downward toward locking member 630.

Intermediate latching member 480 of system 600 may include a vertically-disposed member 650, a horizontally-disposed member 660, a connection mechanism 670, and one or more knobs 680. In the illustrated embodiment of FIG. 6, vertically-disposed member 650 of intermediate latching member 480 is adapted to engage with clip 500*b*, and horizontally-disposed member 660 of intermediate latching member 480 is adapted to engage with intermediate supporting member 410. In certain embodiments, vertically-disposed member 650 extends perpendicularly from an end of horizontally-disposed member 660. Connection mechanism 670 of intermediate supporting member 410 is a latch adapted to engage with locking member 630 of intermediate supporting member 410. In certain embodiments, connection mechanism 670 rotates into locking member 630 of intermediate supporting member 410 during installation of curtain wall member 140*b*.

In certain embodiments, stop 640 of intermediate supporting member 410 prevents connection mechanism 670 from advancing further toward vertically-disposed member 610 of intermediate supporting member 410, which may assist with alignment of curtain wall members 140*a* and 140*b*. In the illustrated embodiment of FIG. 6, knobs 680 abut horizontally-disposed member 620 of intermediate supporting member 410. In certain embodiments, knobs 680 may assist in maintaining proper alignment between horizontally-disposed member 620 of intermediate supporting member 410 and horizontally-disposed member 660 of intermediate latching member 480.

As shown in the illustrated embodiment of FIG. 6, clip 500*a* is coupled to intermediate supporting member 410. Clip 500*a* is used to mount curtain wall member 140*a* to intermediate supporting member 410. In certain embodiments, first hook 520 of clip 500*a* is adapted to receive curtain wall member 140*a*. Body 510 of clip 500*a* may be substantially vertical such that body 510 is parallel to curtain wall member 140*a*. A space between clip 500*a* and body 510 may be filled with silicone 470. In the illustrated embodiment of FIG. 6, an end of lip 560 of clip 500*a* is flush with curtain wall member 140*a*. In certain embodiments, first surface 512 of body 510 faces curtain wall member 140*a* and second surface 514 of body 510 faces wall 420.

In some embodiments, first hook 520 of clip 500*a* is adapted to be inserted in a kerf 145*a* of curtain wall member 140*a*. For example, leg 521*b* of first hook 520 of clip 500*a* may extend in a vertical direction and be inserted in kerf 145*a* located along a bottom end of curtain wall member 140*a*. The portion of the bottom end of curtain wall member 140*a* on one side of kerf 145*a* may be flush with an inner surface of leg 521*a* of first hook 520. The portion of the bottom end of curtain wall member 140*a* on the other side of kerf 145*a* may partially rest on an upper surface of leg 521*a* and partially extend beyond leg 521*a* of clip 500*a*. In certain embodiments, one or more loads (e.g., dead load) induced by curtain wall member 140*a* is transferred to clip 500*a*. For example, clip 500*a* may support a dead load induced by curtain wall member 140*a*.

In the illustrated embodiment of FIG. 6, clip 500*a* is adapted to receive a receiving-and-retaining member 415. In certain embodiments, second hook 530 of clip 500 may be adapted to receive receiving-and-retaining member 415. In certain embodiments, one or more spaces between one or more components of system 600 may be filled with silicone 470. As an example, a space between receiving-and-retaining member 415 of intermediate supporting member 410 and second hook 530 of clip 500*a* may be filled with silicone 470 or another suitable material for securing receiving-and-retaining member 415 of intermediate supporting member 410 to intermediate supporting member 410. As another example, a space between body 510 of clip 500*a* and curtain wall member 140*a* may be filled with silicone 470 or another suitable material for securing body 510 of clip 500*a* to curtain wall member 140*a*. As still another example, a space between curtain wall member 140*a* and leg 521*b* of clip 500*a* may be filled with silicone 470 or another suitable material for securing curtain wall member 140*a* to leg 521*b* of clip 500*a*.

As shown in the embodiment of FIG. 6, plate 540 of clip 500*a* is flush with a surface of intermediate supporting member 410. In certain embodiments, clip 500*a* transfers a load induced by curtain wall member 140*a* to intermediate supporting member 410, and plate 540 of clip 500*a* may assist in distributing the transferred load to intermediate supporting member 410.

Turning to clip 500*b* and curtain wall member 140*b* in the embodiment of FIG. 6, clip 500*b* is located between intermediate latching member 480 and curtain wall member 140*b*. As shown, clip 500*b* may be oriented in a direction that mirrors the orientation of clip 500*a* about an imaginary horizontal line. In certain embodiments, first hook 520 of clip 500*b* is adapted to receive curtain wall member 140*b*. Body 510 of clip 500*b* may be substantially vertical such that body 510 is parallel to curtain wall member 140*b*. A space between clip 500*b* and body 510 may be filled with silicone 470. In the illustrated embodiment of FIG. 6, an end of lip 560 of clip 500*b* is flush with curtain wall member 140*b*. In certain embodiments, first surface 512 of body 510 faces curtain wall member 140*b* and second surface 514 of body 510 faces wall 420.

In some embodiments, first hook 520 of clip 500*b* is inserted in kerf 145*b* of curtain wall member 140*b*. For example, leg 521*b* of first hook 520 may extend in a vertical direction and be inserted in kerf 145*b* located along a top end of curtain wall member 140*b*. The portion of the top end of curtain wall member 140*b* on one side of kerf 145*b* may rest on and/or be flush with an inner surface of leg 521*a* of first hook 520. The portion of the top end of curtain wall member 140*b* on the other side of kerf 145*b* may extend beyond clip 500*b*. In certain embodiments, a load induced by curtain wall member 140*b* is transferred to clip 500*b*.

In the illustrated embodiment of FIG. 6, clip 500*b* is adapted to receive intermediate latching member 480. For example, second hook 530 of clip 500*b* may be adapted to receive vertically-disposed member 650 of intermediate latching member 480. In certain embodiments, a space between clip 500*b* and one or more other components of system 800 may be filled with silicone 470 or another suitable material. As an example, a space between channel 535 of clip 500*b* and vertically-disposed member 650 of intermediate latching member 480 may be filled with silicone 470 or another suitable material for securing channel 535 of clip 500*b* to vertically-disposed member 650 of intermediate latching member 480. As another example, a space between curtain wall member 140*b* and leg 521*b* of clip 500*b* may be filled with silicone 470 or another suitable material for securing curtain wall member 140*b* to leg 521*b* of clip 500*b*.

As shown in the embodiment of FIG. 6, plate 540 of clip 500*b* is flush with foam 490. Foam 490 is situated between plate 540 and intermediate latching member 480. Foam 490 may be foam tape with expansive and/or compressive properties. In certain embodiments, clip 500*b* transfers one or more loads induced by curtain wall member 140*b* to intermediate latching member 480. Intermediate latching member 480 may transfer load received from clip 500*b* to intermediate supporting member 410. Intermediate supporting member 410 may transfer load (e.g., load received from intermediate latching member 480) to wall 420. Plate 540 of clip 500*b* may assist in distributing load (e.g., load transferred to plate 540) to intermediate latching member 480 through foam 490. In some embodiments, intermediate latching member 480 may assist in the alignment of clip 500*b*.

FIG. 7 illustrates an example installation process for mounting a curtain wall member 140 to a wall using clip 500 according to certain embodiments of the present disclosure. Specifically, FIG. 7 illustrates placement of clip 500*a* into intermediate supporting member 410*a* and placement of clip 500*b* and 500*c* into intermediate latching members 480*a* and 480*b*, respectively. Although the example installation process of FIG. 7 is illustrated and described using clip 500, the present disclosure contemplates a substantially similar installation process being performed using clip 200 or any other suitable apparatus within the scope of the present disclosure.

FIG. 7 includes three stages 710, 720, and 730 for placement of clip 500*a*, 500*b*, and 500*c*. At all three stages 710, 720, and 730, mounting of curtain wall member 140*b* (using clip 500*b*) has already been completed. For example, as shown, clip 500*b* is fully engaged with curtain wall member 140*b* and intermediate latching member 480*a*, and intermediate latching member 480*a* is fully engaged with intermediate supporting member 410*a*. In certain embodiments, intermediate supporting members 410*a* and 410*b* may be fastened to a wall (e.g., wall 420 of FIG. 4) with one or more fasteners 440.

At stage 710 of FIG. 7, clip 500*a* is inserted into kerf 145*a* of curtain wall member 140*a*. In certain embodiments, a lower end of curtain wall member 140*a* is received by channel 525 of clip 500*a*. Silicone 470 is applied between clip 500*a* and curtain wall member 140*a*. Silicone 470 may help stabilize clip 500*a* in relation to curtain wall member 140*a*. As shown at stage 710 in FIG. 7, engagement between clip 500*a* and intermediate supporting member 410*a* is initiated such that an upper portion of receiving-and-retaining member 415 of intermediate supporting member 410*a* is located within channel 535 of clip 500*a*.

Clip 500*c* is inserted into kerf 145*c* of curtain wall member 140*a* at stage 710 of FIG. 7. In certain embodiments, an upper end of curtain wall member 140*a* is received by channel 525 of clip 500*c*. Clip 500*c* also receives intermediate latching member 480*b* at stage 710. As shown, intermediate latching member 480*b* engages with channel 535 of clip 500*c*. Silicone 470 is applied between clip 500*c* and curtain wall member 140*a* and between clip 500*c* and intermediate latching member 480*b*. In certain embodiments, foam 490 may be affixed to intermediate latching member 480*b* such that foam 490 is located between intermediate latching member 480*b* and plate 540 of clip 500. In the illustrated embodiment of stage 710 of FIG. 7, curtain wall member 140*a* is shown at an angle to curtain wall member 140*b* such that the outer surfaces of curtain walls 140*a* and 140*b* are located on different planes.

Stage 720 of FIG. 7 demonstrates an installation stage of curtain wall member 140*a* as curtain wall member 140*a* is rotated into place from stage 710. As shown, curtain wall member 140*a*, clip 500*a*, clip 500*c*, and intermediate latching member 480*b* have been rotated (e.g., pivoted) about receiving-and-retaining member 415 of intermediate supporting member 410*a*. At stage 720 of FIG. 7, clip 500*a* is further engaged with intermediate supporting member 410*a* in comparison to stage 710 such that a majority of receiving-and-retaining member 415 of intermediate supporting member 410*a* is located within channel 535 of clip 500*a*.

At stage 720, as curtain wall member 140*a* is rotated into position, an upper surface of intermediate latching member 480*b* slides against a lower surface of horizontally-disposed member 620 of intermediate supporting member 410*b*, and foam 490 is compressed. Connection mechanism 670 of intermediate latching member 480 approaches locking member 630 of intermediate supporting member 410*b*. In the illustrated embodiment of stage 720 of FIG. 7, curtain wall member 140*a* is shown at an angle to curtain wall member 140*b* such that the outer surfaces of curtain walls 140*a* and 140*b* are located on different planes. As shown in FIG. 7, the outer surface plane of curtain wall 140*a* intersects the outer surface plane of curtain wall 140*b* at a greater angle at stage 720 than at stage 710.

As discussed above, in the illustrated example, second channel 535 of clip 500 is wider at the base of channel 535 near leg 531*a* and narrower at the opposite end of second channel 535 near leg 521*a*, with the width narrowing gradually from the base of second channel 535 to the opposite end of channel 535. In certain embodiments, the wider base of second channel 535 provides flexibility for intermediate latching member 480 to rotate when engaging with intermediate supporting member 410, potentially easing the process of installing curtain wall members 140.

Stage 730 of FIG. 7 demonstrates a final installation stage of curtain wall member 140*a* after curtain wall member

140*a* has been rotated into place. As shown, clip 500*a* is fully engaged with intermediate supporting member 410*a* and clip 500*b* is fully engaged with intermediate latching member 480*b*. Intermediate latching member 480*b* is fully engaged with intermediate supporting member 410*b*. Knobs 680 of intermediate latching member 480*b* are in contact with a lower surface of horizontally-disposed member 620 of intermediate supporting member 410*b*. Connection mechanism 670 of intermediate latching member 480 is fully engaged with locking member 630 of intermediate supporting member 410*b*. The outer surface of curtain wall member 140*a* is flush with the outer surface of curtain wall member 140*b* such that the outer surfaces of curtain wall members 140*a* and 140*b* are aligned in the same plane.

In certain embodiments, once connection mechanism 670 of intermediate latching member 480 is locked in place in locking member 630, foam 490 may decompress, ensuring proper alignment of intermediate latching member 480 against horizontally disposed member 620. In certain embodiments, foam 490 beneath intermediate latching member 480 forces intermediate latching member 480 to become flush with horizontally disposed member 620, setting intermediate latching member 480 in proper engagement position. In certain embodiments, foam 490 may continue to hold intermediate latching member 480 in place until silicon 470 sets to hold intermediate latching member 480 in place. In certain embodiments, knobs 680 of intermediate latching member 480 may abut horizontally disposed member 620. In certain embodiments, knobs 680 may advantageously help maintain proper alignment between the intermediate latching member 480 and horizontally disposed member 620.

As shown in the installation process illustrated in FIG. 7, in certain embodiments, clips 500*a* and 500*c* may be attached to curtain wall member 140*a* prior to mounting of curtain wall member 140*a* to intermediate supporting members 410*a* and 410*b*, which may ease the installation process of installing curtain wall members 140, potentially reducing the burden on the installer to manually hold one or more installation components in place while mounting the curtain wall member 140 to the supporting structure, and/or increase installation speed.

Modifications, additions, or omissions may be made to the process depicted in FIG. 7. The process may include more, fewer, or other steps. Steps may also be performed in parallel or in any suitable order.

Particular embodiments of the present disclosure may provide one or more technical advantages. For example, in certain embodiments, thin curtain wall members 140, such as curtain wall members 140 having a thickness of approximately 0.5 inches (as just one particular example), may be installed with one or more members (e.g., clips 200 and/or 500) of the present disclosure in lieu of support anchors (e.g., undercut anchors), which may be aesthetically undesirable and which may not be suitable for thin curtain wall members 140 (e.g., curtain wall members less than six inches thick.) In certain embodiments, the present disclosure may include a hook (e.g., hook 220 and/or hook 520) adapted to receive and/or support a bottom end of a curtain wall member. Some embodiments of the present disclosure may include a leg (e.g., leg 221*b* and/or leg 521*b*) of the hook (e.g., hook 220 and/or hook 520) that engages with a kerf (e.g., kerf 145) located along the bottom surface of the curtain wall member 140, which may provide for alignment of the curtain wall member 140.

As another technical advantage of certain embodiments, it may be desirable in some instances to provide support and alignment along both the top and bottom ends of a curtain wall member 140. In certain embodiments, rather than using a different member to align and/or support the top and bottom ends of the curtain wall member 140, the present disclosure includes a versatile member (e.g., clip 200 and/or 500) that can align and/or support the top and/or bottom ends of the curtain wall member 140 by changing the orientation of the member (e.g., clip 200 and/or 500), which may lower manufacturing costs and increase installation speed in the field.

As still another technical advantage of certain embodiments, the present disclosure may include one or more clips (e.g., clip 200 and/or 500) that can be attached to curtain wall members 140 prior to installation of the curtain wall members 140 onto a supporting structure for supporting the curtain wall members 140 of a curtain walls. The clips (e.g., clips 200 and/or 500) may allow the curtain wall members 140 to be mechanically mounted onto the supporting structure of the curtain wall, which may simplify the installation process, potentially reducing the burden on the installer to manually hold one or more installation components in place while mounting the curtain wall member 140 to the supporting structure, and/or increase installation speed.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims. Although the figures and accompanying description may describe a curtain wall system in accordance with certain embodiments of the present disclosure that is oriented in a particular direction, the present disclosure contemplates that the orientation of the curtain wall system and its various components may be varied in any suitable manner. As an example, the described supporting structures may be modified such that the orientation of the curtain wall system is substantially flipped.

What is claimed is:

1. A system, comprising:

a curtain wall member;

a first intermediate member comprising a horizontally-disposed member and a receiving-and-retaining member;

a second intermediate member comprising a horizontally-disposed member and a locking member, wherein the first and second intermediate members are adapted to be coupled to a wall, the second intermediate member adapted to be positioned above and parallel to the first intermediate member, with the locking member located below the horizontally-disposed member of the second intermediate member, when the first and second intermediate members are coupled to the wall; and a first apparatus and a second apparatus, each of the first apparatus and the second apparatus comprising a body, a first hook, and a second hook, wherein for each of the first apparatus and the second apparatus:

the body comprises a first surface and a second surface opposite to the first surface;

the first hook is integrally coupled to the first surface of the body, the first hook and a portion of the body forming a first channel; and the second hook is integrally coupled to the second surface of the body, the second hook and the portion of the body forming a second channel, the second hook comprising a first leg and a second leg, the first leg being integrally coupled to the second surface of the body at a first end of the first leg of the second hook, a first end of the second leg of the second hook being coupled to the first leg of the second hook at a second end of the first leg of the second hook, the first channel and the second channel being open to opposing directions;

wherein:

the first channel of the first hook of the first apparatus is adapted to engage with a bottom end of the curtain wall member and, for the first apparatus to engage with the first intermediate member, the second channel of the second hook of the first apparatus is adapted to receive the receiving-and-retaining member of the first intermediate member; and the first channel of the first hook of the second apparatus is adapted to engage with a top end of the curtain wall member and, for the second apparatus to engage with the second intermediate member, the second channel of the second hook of the second apparatus is adapted to receive a vertically-disposed member of an intermediate latching member that is adapted to engage with the locking member of the second intermediate member, engagement of the first apparatus with the first intermediate member and the second apparatus with the second intermediate member securing the curtain wall member in position on the wall, the intermediate latching member being distinct from the second intermediate member.

2. The system of claim 1, wherein, for the first apparatus:

the body of the first apparatus is substantially vertical when the curtain wall member is mounted to the wall via the first apparatus, the second apparatus, the first and second intermediate members, and the intermediate latching member;

a first leg of the first hook of the first apparatus is integrally coupled to a lower end of the first surface of the body of the first apparatus;

a second leg of the first hook of the first apparatus is adapted to be inserted in a kerf located along the bottom end of the curtain wall member; and the receiving-and-retaining member of the first intermediate member extends perpendicularly from an end of the horizontally-disposed member of the first intermediate member.

3. The system of claim 2, wherein, for the second apparatus:

the body of the second apparatus is substantially vertical when the curtain wall member is mounted to the wall via the first apparatus, the second apparatus, the first and second intermediate members, and the intermediate latching member;

a first leg of the first hook of the second apparatus is integrally coupled to an upper end of the first surface of the body of the second apparatus; and a second leg of the first hook of the second apparatus is adapted to be inserted in a kerf located along the top end of the curtain wall member.

4. The system of claim 1, wherein a width of the first channel of the first apparatus is different from a width of the second channel of the first apparatus.

5. The system of claim 1, wherein the first apparatus further comprises a lip integrally coupled to an end of the first surface of the body of the first apparatus.

6. The system of claim 1, wherein the first apparatus is plastic and the first intermediate member is plastic.

7. The system of claim 1, wherein the first leg of the second hook of the first apparatus extends substantially perpendicularly from the body of the first apparatus.

8. The system of claim 1, wherein the first apparatus is coupled to the bottom end of the curtain wall member using the first hook of the first apparatus and the second apparatus is coupled to the top end of the curtain wall member using the first hook of the second apparatus.

9. The system of claim 1, wherein, when the first channel of the first hook of the first apparatus is engaged with the bottom end of the curtain wall member and the first channel of the first hook of the second apparatus is engaged with the top end of the curtain wall member, to secure the curtain wall member to the wall:

the second channel of the of the second hook of the first apparatus is adapted to receive the receiving-and-retaining member of the first intermediate member; and the curtain wall member and second apparatus are adapted to be subsequently rotated toward the wall, the second channel of the second hook of the second apparatus having received the vertically-disposed member of the intermediate latching member, to engage the intermediate latching member with the locking member of the second intermediate member.

10. A system, comprising:

a curtain wall member;

a first intermediate member comprising a horizontally-disposed member and a receiving-and-retaining member;

a second intermediate member comprising a horizontally-disposed member and a locking member, wherein the first and second intermediate members are adapted to be coupled to a wall, the second intermediate member adapted to be positioned above and parallel to the first intermediate member, with the locking member located below the horizontally-disposed member of the second intermediate member, when the first and second intermediate members are coupled to the wall; and a first apparatus and a second apparatus, each of the first apparatus and the second apparatus comprising a body, a first hook, and a second hook, wherein for each of the first apparatus and the second apparatus:

the body comprises a first surface and a second surface opposite to the first surface;

the first hook is integrally coupled to the first surface of the body, the first hook and a portion of the body forming a first channel; and the second hook is integrally coupled to the second surface of the body, the second hook and the portion of the body forming a second channel, the second hook comprising a first leg and a second leg, the first leg being integrally coupled to the second surface of the body at a first end of the first leg of the second hook, a first end of the second leg of the second hook being coupled to the first leg of the second hook at a second end of the first leg of the second hook, the first channel and the second channel being open to opposing directions;

wherein:

the first channel of the first hook of the first apparatus is adapted to engage with a bottom end of the curtain wall member and, for the first apparatus to engage with the first intermediate member, the second channel of the second hook of the first apparatus is adapted to receive the receiving-and-retaining member of the first intermediate member;

the first channel of the first hook of the second apparatus is adapted to engage with a top end of the curtain wall member and, for the second apparatus to engage with the second intermediate member, the second channel of the second hook of the second apparatus is adapted to receive a vertically-disposed member of an intermediate latching member that is adapted to engage with the locking member of the second intermediate member, engagement of the first apparatus with the first intermediate member and the second apparatus with the second intermediate member securing the curtain wall member in position on the wall, the intermediate latching member being distinct from the second intermediate member;

the first apparatus further comprises a first plate integrally coupled to the second hook of the first apparatus and extending from an end of the second leg of the second hook of the first apparatus in a direction perpendicular to and away from the body of the first apparatus, wherein when the curtain wall member is mounted to the wall via the first apparatus, the second apparatus, and the first and second intermediate members, and the intermediate latching member, the first plate physically contacts a surface of the horizontally-disposed member of the first intermediate member to distribute to the first intermediate member a load induced on the first apparatus by the curtain wall member; and the second apparatus further comprises a second plate integrally coupled to the second hook of the second apparatus and extending from an end of the second leg of the second hook of the second apparatus in a direction perpendicular to and away from the body of the second apparatus, wherein foam positioned between the second plate and the intermediate latching member is configured to hold intermediate latching member in place while silicone in the second channel of the second hook of the second apparatus sets to hold the intermediate latching member in place.

11. The system of claim 10, wherein, for the first apparatus:

the body of the first apparatus is substantially vertical when the curtain wall member is mounted to the wall via the first apparatus, the second apparatus, the first and second intermediate members, and the intermediate latching member;

a first leg of the first hook of the first apparatus is integrally coupled to a lower end of the first surface of the body of the first apparatus;

a second leg of the first hook of the first apparatus is adapted to be inserted in a kerf located along the bottom end of the curtain wall member; and the receiving-and-retaining member of the first intermediate member extends perpendicularly from an end of the horizontally-disposed member of the first intermediate member.

12. The system of claim 11, wherein, for the second apparatus:

the body of the second apparatus is substantially vertical when the curtain wall member is mounted to the wall via the first apparatus, the second apparatus, the first and second intermediate members, and the intermediate latching member;

a first leg of the first hook of the second apparatus is integrally coupled to an upper end of the first surface of the body of the second apparatus; and a second leg of the first hook of the second apparatus is adapted to be inserted in a kerf located along the top end of the curtain wall member.

13. The system of claim 10, wherein a width of the first channel of the first apparatus is different from a width of the second channel of the first apparatus.

14. The system of claim 10, wherein the first surface of the body of the first apparatus is smooth and a portion of the second surface of the body of the first apparatus is serrated.

15. The system of claim 10, wherein the first apparatus further comprises a lip integrally coupled to an end of the first surface of the body of the first apparatus.

16. The system of claim 10, wherein the first apparatus is plastic and the first intermediate member is plastic.

17. The system of claim 10, wherein the first leg of the second hook of the first apparatus extends substantially perpendicularly from the body of the first apparatus.

18. The system of claim 10, wherein the second intermediate member further comprises a receiving-and-retaining member.

19. The system of claim 10, wherein the first apparatus is coupled to the bottom end of the curtain wall member using the first hook of the first apparatus and the second apparatus is coupled to the top end of the curtain wall member using the first hook of the second apparatus.

20. A system, comprising:

a curtain wall member;

a first intermediate member comprising a horizontally-disposed member and a receiving-and-retaining member;

a second intermediate member comprising a horizontally-disposed member and a locking member, wherein the first and second intermediate members are adapted to be coupled to a wall, the second intermediate member adapted to be positioned above and parallel to the first intermediate member, with the locking member located below the horizontally-disposed member of the second intermediate member, when the first and second intermediate members are coupled to the wall; and a first apparatus and a second apparatus, each of the first apparatus and the second apparatus comprising a body, a first hook, and a second hook, wherein for each of the first apparatus and the second apparatus:

the body comprises a first surface and a second surface opposite to the first surface;

the first hook is integrally coupled to the first surface of the body, the first hook and a portion of the body forming a first channel; and the second hook is integrally coupled to the second surface of the body, the second hook and the portion of the body forming a second channel, the second hook comprising a first leg and a second leg, the first leg being integrally coupled to the second surface of the body at a first end of the first leg of the second hook, a first end of the second leg of the second hook being coupled to the first leg of the second hook at a second end of the first leg of the second hook, the first channel and the second channel being open to opposing directions, the second leg of the second hook being angled toward the body such that the second channel is wider at a base of the second channel near the first leg of the second hook and narrower at an opposite end of the second channel, wherein a plate is integrally coupled to the second hook and extends from an end of the second leg of the second hook in a direction perpendicular to and away from the body such that an acute angle is formed between the second leg of the second hook and the plate;

wherein:

the first channel of the first hook of the first apparatus is adapted to engage with a bottom end of the curtain wall member and, for the first apparatus to engage with the first intermediate member, the second channel of the second hook of the first apparatus is adapted to receive the receiving-and-retaining member of the first intermediate member;

the first channel of the first hook of the second apparatus is adapted to engage with a top end of the curtain wall member and, for the second apparatus to engage with the second intermediate member, the second channel of the second hook of the second apparatus is adapted to receive a vertically-disposed member of an intermediate latching member that is adapted to engage with the locking member of the second intermediate member, the intermediate latching member being distinct from the second intermediate member; and when the first channel of the first hook of the first apparatus is engaged with the bottom end of the curtain wall member and the first channel of the first hook of the second apparatus is engaged with the top end of the curtain wall member, to secure the curtain wall member to the wall:

the second channel of the second hook of the first apparatus is adapted to receive the receiving-and-retaining member of the first intermediate member; and the curtain wall member and second apparatus are adapted to be subsequently rotated toward the wall, the second channel of the second hook of the second apparatus having received the vertically-disposed member of the intermediate latching member, to engage the intermediate latching member with the locking member of the second intermediate member.

* * * * *